US007442225B2

(12) United States Patent
Takada et al.

(10) Patent No.: US 7,442,225 B2
(45) Date of Patent: Oct. 28, 2008

(54) HIGH STRENGTH HIGH TOUGHNESS MO ALLOY WORKED MATERIAL AND METHOD FOR PRODUCTION THEREOF

(75) Inventors: Jun Takada, Okayama (JP); Masahiro Nagae, Okayama (JP); Makoto Nakanishi, Okayama (JP); Tomohiro Takida, Toyama (JP); Tetsushi Hoshika, Okayama (JP)

(73) Assignees: Japan Science and Technology Agency, Kawaguchi-shi (JP); National University Corporation Okayama University, Okayama-shi (JP); A.L.M.T. Corp., Tokyo (JP)

( * ) Notice: Subject to any disclaimer, the term of this patent is extended or adjusted under 35 U.S.C. 154(b) by 495 days.

(21) Appl. No.: 10/509,158

(22) PCT Filed: Mar. 27, 2003

(86) PCT No.: PCT/JP03/03913

§ 371 (c)(1),
(2), (4) Date: Jun. 24, 2005

(87) PCT Pub. No.: WO03/083158

PCT Pub. Date: Oct. 9, 2003

(65) Prior Publication Data

US 2006/0048866 A1 Mar. 9, 2006

(30) Foreign Application Priority Data

Mar. 29, 2002 (JP) ..... 2002-098015

(51) Int. Cl.
*B22F 3/24* (2006.01)
*C23C 8/24* (2006.01)

(52) U.S. Cl. ..... 75/245; 75/233; 75/236; 75/238; 75/244; 148/207; 148/237; 148/317

(58) Field of Classification Search ..... 75/232, 75/233, 236, 238, 244, 245; 148/207, 237, 148/514, 317; 419/10, 13, 14, 19, 28, 29
See application file for complete search history.

(56) References Cited

U.S. PATENT DOCUMENTS 3,013,329 A * 12/1961 Fraser ..... 428/568
3,161,949 A * 12/1964 Dickinson et al. ..... 75/244
4,165,982 A 8/1979 F. Tatsuo et al.
4,514,234 A * 4/1985 Fukasawa et al. ..... 148/514
4,950,327 A * 8/1990 Eck et al. ..... 75/232
5,051,139 A * 9/1991 Eck ..... 148/514
5,868,876 A * 2/1999 Bianco et al. ..... 148/407
6,589,368 B1 * 7/2003 Takada et al. ..... 148/317

FOREIGN PATENT DOCUMENTS

| | | |
|---|---|---|
| JP | 59-208066 | 11/1984 |
| JP | 7-242483 | 9/1995 |
| JP | 2001-73060 | 3/2001 |
| WO | WO01/18276 | 3/2001 |

OTHER PUBLICATIONS

Masahiro Nagae et al.; The Japan Institute of Metals, vol. 64, No. 9, pp. 747-750, 2000. Cited in the specification.
Masahiro Nagae et al.; The Japan Institute of Metals, vol. 64, No. 9, pp. 751-754, 2000. Cited in the specification.
Supplementary European Search Report dated Sep. 17, 2008, issued in corresponding European patent application No. 03745434.
James S. Kane, "Creep of Internally nitrided Molybdenum-Based Alloy in a Nitrogen Environment", Metallurgical Transactions, vol. 1, Feb. 1970.

* cited by examiner

*Primary Examiner*—Roy King
*Assistant Examiner*—Ngoclan T Mai
(74) *Attorney, Agent, or Firm*—Westerman, Hattori, Daniels & Adrian, LLP.

(57) ABSTRACT

The present invention provides a worked molybdenum-alloy material that can be used at higher temperatures than at least temperatures at which known TZM alloys are used.

A worked molybdenum-alloy material having high strength and high toughness includes at least one of carbide particles, oxide particles, and boride particles and fine nitride particles dispersed by internal nitriding of an untreated worked molybdenum-alloy material in which a nitride-forming-metal element is dissolved to form a solid solution in a molybdenum matrix and at least one of carbide particles, oxide particles, and boride particles is precipitated and dispersed. The worked molybdenum-alloy material is manufactured by subjecting a worked alloy material, which has a matrix composed of molybdenum, in which at least one of carbide particles, oxide particles, and boride particles is precipitated and dispersed and in which at least one of titanium, zirconium, hafnium, vanadium, niobium, and tantalum is dissolved to form a solid solution, to multi-step internal nitriding treatment including a stepwise increase of the treatment temperature.

2 Claims, 2 Drawing Sheets

Material After Second Nitriding

Material After Fourth Nitriding

HIGH STRENGTH HIGH TOUGHNESS MO ALLOY WORKED MATERIAL AND METHOD FOR PRODUCTION THEREOF

TECHNICAL FIELD

The present invention relates to a worked molybdenum-alloy material having high strength and high toughness produced by internal nitriding treatment, and a method for manufacturing the worked molybdenum-alloy material.

BACKGROUND ART

Molybdenum (Mo) that has, for example, a high melting point (about 2600° C.), relatively high mechanical strength superior to other metals having high melting points, a low thermal expansion coefficient, excellent electrical conduction and thermal conduction properties, and a high corrosion resistance to a melted alkali metal and hydrochloric acid, can be applied to, for example, electrodes, components for vessels, components for semiconductors, components for heat-resistant structures, and materials for nuclear reactors.

A worked material having a worked structure exhibits high toughness due to suppressed crack growth. However, in a material recrystallized by heating (about 1050° C. or more), strength at high temperatures is not satisfactory because a crack readily grows to cause embrittlement. Therefore, Mo—Ti(0.5)—Zr(0.08)—C(0.03) (TZM) alloy and Mo—Nb(1.5)—Ti(0.5)—Zr(0.03)—C(0.03) (TZC) alloy have been developed as molybdenum alloys having improved strength at high temperatures.

The inventors found that, in a worked refractory-metal-alloy material such as an ultrafine-nitride-containing molybdenum alloy formed by multi-step internal nitriding treatment, high toughness and high strength are achieved by maintaining a worked structure in at least the surface region of the worked material (patent document 1, non-patent documents 1 to 3).

Patent document 1: Japanese Unexamined Patent Application Publication No. 2001-73060.

Non-patent document 1: Masahiro Nagae, Jun Takada, Yoshito Takemoto, Yutaka Hiraoka, and Tetsuo Yoshio. J. Japan Inst. Metals, 64(2000)747-750.

Non-patent document 2: Masahiro Nagae, Jun Takada, Yutaka Hiraoka, Yoshito Takemoto, and Tetsuo Yoshio. J. Japan Inst. Metals, 64(2000)751-754.

Non-patent document 3: Masahiro Nagae, Jun Takada, Yutaka Hiraoka, and Yoshito Takemoto, Materia Japan, 40(2001)666-667.

DISCLOSURE OF INVENTION

Molybdenum alloys have the following major problems: (1) Molybdenum alloys exhibit low-temperature brittleness when the molybdenum alloys are heated to their recrystallization temperature (1100° C. to 1300° C.) or more to be recrystallized and (2) strength is low at high temperatures.

TZM alloys (for example, Mo—Ti(0.5)—Zr(0.08)—C (0.03)) that contain fine-grained carbide particles such as (Ti, Zr)C have satisfactory processability at room temperature, high recrystallization temperatures of about 1300° C. to about 1400° C., and excellent strength at 1100° C. or less. However, the TZM alloys cannot be used at 1500° C. or more because recrystallization occurs to cause embrittlement.

Even the above-described TZM alloys, which are excellent materials containing molybdenum among known materials since their recrystallization temperatures are 1300° C. to 1400° C., cannot be used at 1500° C. or more because recrystallization occurs to cause embrittlement. In addition, since the TZM alloys that are high-strength materials are hard to process, complicated products are difficult to manufacture.

It is an object of the present invention to provide a worked molybdenum-alloy material that can be used at higher temperatures than temperatures at which known TZM alloys are used, and a method for manufacturing the worked molybdenum-alloy material.

The inventors found that a worked molybdenum-alloy material having high strength and high toughness is produced by the following procedure: A worked molybdenum-alloy material in which at least any one of fine carbide particles, fine oxide particles, and fine boride particles are precipitated and dispersed and in which a nitride-forming element such as titanium (Ti), zirconium (Zr), hafnium (Hf), vanadium (V), niobium (Nb), or tantalum (Ta) is dissolved to form a solid solution is subjected to multi-step internal nitriding treatment including a stepwise increase of the heating temperature. As a result, strengthening is achieved by dispersion of these multiple kinds of particles, and these fine particles also have the effect of preventing the grain boundary of the molybdenum crystals from moving to control the recrystallization.

That is, a worked molybdenum-alloy material having high strength and high toughness includes at least one of carbide particles, oxide particles, and boride particles and fine nitride particles dispersed by internal nitriding of an untreated worked molybdenum-alloy material in which a nitride-forming-metal element is dissolved to form a solid solution in a molybdenum matrix and at least one of carbide particles, oxide particles, and boride particles is precipitated and dispersed.

In the above-described worked molybdenum-alloy material having high strength and high toughness, at least the surface region of the worked molybdenum-alloy material having high strength and high toughness is composed of a worked structure or a recovered structure.

In the worked molybdenum-alloy material having high strength and high toughness, a worked structure or a recovered structure is maintained through the entire worked molybdenum-alloy material having high strength and high toughness.

In the worked molybdenum-alloy material having high strength and high toughness, the worked molybdenum-alloy material has a double-layer formation including a surface region maintaining a worked structure or a recovered structure and the inside of the worked molybdenum-alloy material, having high strength and high toughness, composed of a recrystallized structure.

Furthermore, the present invention provides a method for manufacturing the above-described worked molybdenum-alloy material having high strength and high toughness includes the step of subjecting an untreated worked alloy material, which has a matrix composed of molybdenum, in which at least one of carbide particles, oxide particles, and boride particles is precipitated and dispersed and in which at least one of titanium, zirconium, hafnium, vanadium, niobium, and tantalum is dissolved to form a solid solution, to multi-step internal nitriding treatment including a stepwise increase of the treatment temperature.

BRIEF DESCRIPTION OF THE DRAWINGS

FIG. 3(*b*) is a cross-sectional micrograph, which is an alternative to a drawing, with an optical microscope showing a metal structure of a material after fourth nitriding.

BEST MODE FOR CARRYING OUT THE INVENTION

Figure 1:
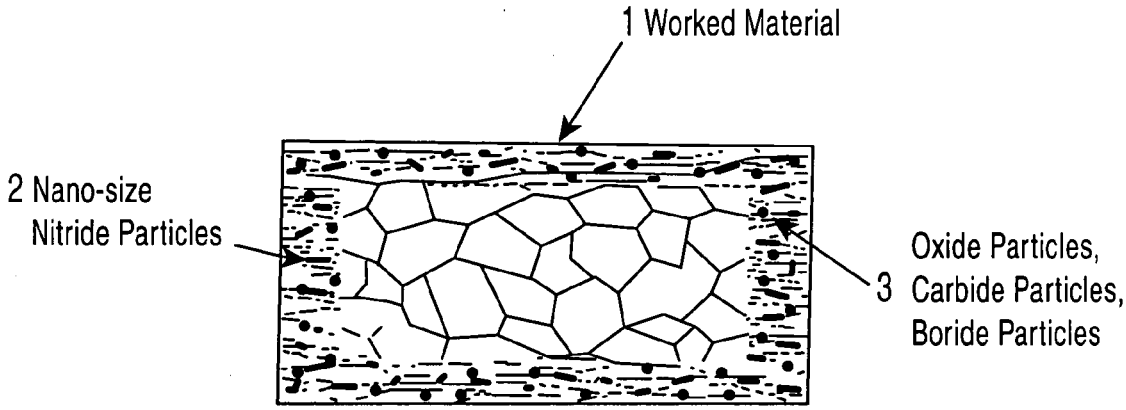
FIG. 1 is a schematic cross-sectional view of a worked molybdenum-alloy material subjected to nitriding of the present invention.

FIG. 1 is a schematic cross-sectional view of a worked molybdenum-alloy material subjected to nitriding of the present invention. The worked molybdenum-alloy material subjected to nitriding of the present invention has a layer including at least two kinds of precipitated fine particles, namely nitride nanoparticles 2 dispersed in the surface region of a worked material 1 and particles 3 composed of at least any one of carbide particles, oxide particles, and boride particles.

A worked material is produced by processing, for example, rolling a dilute alloy which has a matrix composed of molybdenum and in which at least any one of titanium (Ti), zirconium (Zr), hafnium (Hf), vanadium (V), niobium (Nb), or tantalum (Ta) is dissolved to form a solid solution. The worked material is also not a recrystallized material. The term "dilute alloy" means an alloy in which the content of the solute element(s) in a solid solution alloy is about 5 percent by weight or less.

A process for manufacturing an alloy which has a matrix composed of molybdenum and in which carbide particles, oxide particles, or boride particles is precipitated and dispersed is known. For example, a TZM alloy and a TZC alloy have been manufactured by hot-working-processing, for example, hot-extruding, forging, or rolling ingots produced by arc melting or powder metallurgy.

An example of an alloy in which oxide particles are dispersed includes a molybdenum alloy containing 1.0 percent by weight of lanthanum oxide (La2O3). A lanthanum nitrate aqueous solution is added to a molybdenum dioxide powder and dried. The resulting mixture is subjected to hydrogen reduction to form a Mo powder containing 1.0 percent by weight of La2O3. The resulting powder is subjected to hydrostatic pressing and then sintered at 2,070K for 36 ks in a hydrogen flow to form a sintered body. The resulting sintered body is subjected to hot rolling or cold rolling to form into a plate.

An alloy in which carbide particles are dispersed, for example, Mo—TiC, Mo—ZrC, Mo—HfC, and Mo—TaC, can be manufactured as follows: Each carbide powder is added to a molybdenum powder. The resulting mixture is subjected to mechanical alloying with a ball mill. Then the resulting molybdenum powder in which carbide is dispersed is charged into a can and then subjected to hot isostatic pressing (HIP) or spark plasma sintering.

To retain at least any one metal of Ti, Zr, Hf, V, Nb, and Ta as a solute metal, a process in which a green compact composed of material powders is subjected to hydrogen reduction may be employed. For example, a molybdenum powder is mixed with a little extra titanium carbide powder and then the mixture is formed into a green compact. The green compact is subjected to partial hydrogen reduction. As a result, a titanium solute metal is formed from part of the titanium carbide. Then the hydrogen-reduced compact is sintered by the above-described process to produce a molybdenum-titanium alloy containing titanium carbide (Mo—Ti—TiC alloy).

Figure 2:
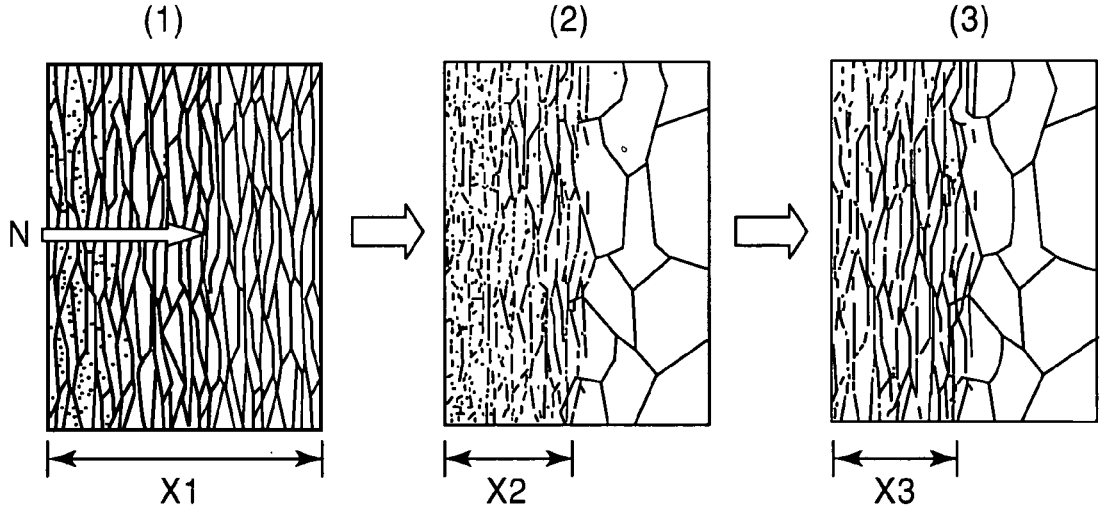
FIG. 2 is a schematic view showing the structures of a worked material at each step (1) to (3) of the internal nitriding treatment in a manufacturing process of a worked molybdenum-alloy material subjected to nitriding.

A worked molybdenum-alloy material, which is subjected to nitriding, having high strength and high toughness according to the present invention is manufactured by internal nitriding treatment including steps (1) to (3) described below. FIG. 2 shows schematic views (1) to (3) illustrating the structures of a worked material at each step (1) to (3), respectively, of the internal nitriding treatment including a stepwise increase of the heating temperature.

(1) First internal nitriding step: A worked material is heated in a nitriding atmosphere between a temperature 200° C. lower than the lower limit temperature of recrystallization and the upper limit temperature of recrystallization to nitride a nitride-forming-metal element. As a result, a worked material in which ultrafine nitride particles are dispersed is formed. In this first nitriding step, nitrogen is diffused into a worked dilute-alloy material while maintaining a worked structure X1 in the worked material. As a result, the nitride-forming-metal element that is dissolved to form a solid solution in a matrix is subjected to preferential nitriding to form subnano nitride particles, which have diameters of about 1 to about 2 nm, in the form of plates, the subnano nitride particles being dispersed in the matrix. The term "preferential nitriding" means a phenomenon in which a nitride-forming-metal element alone is preferentially nitrided but a metal constituting a matrix is not nitrided. A recrystallization temperature is increased due to the pinning effect of the particles precipitated during this nitriding step.

For example, specimens composed of a starting worked TZM-alloy material were nitrided at 1200° C. and 1300° C. for 25 hours, and then the crystal grain structures of the cross-section of the resulting specimens were observed. A worked structure which was similar to that of an unnitrided material was maintained in the specimen nitrided at 1200° C., while a recrystallized structure was partially formed in the specimen nitrided at 1300° C. That is, in a starting TZM alloy, recrystallization occurs during nitriding at 1300° C. or more. Therefore, first nitriding needs to be performed at 1200° C. or less.

Figure 3A:
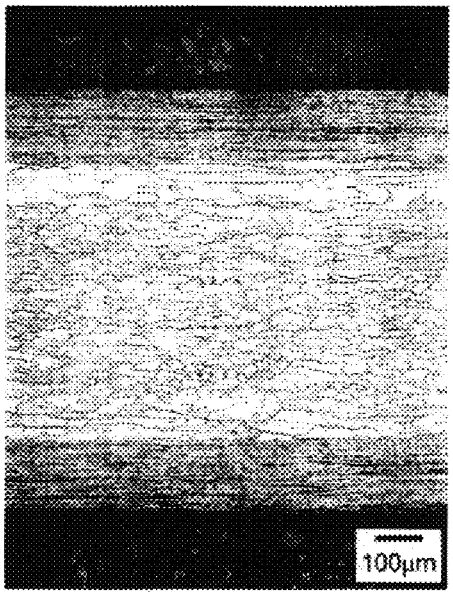
FIG. 3(*a*) is a cross-sectional micrograph, which is an alternative to a drawing, with an optical microscope showing a metal structure of a material after second nitriding.
Figure 3B:
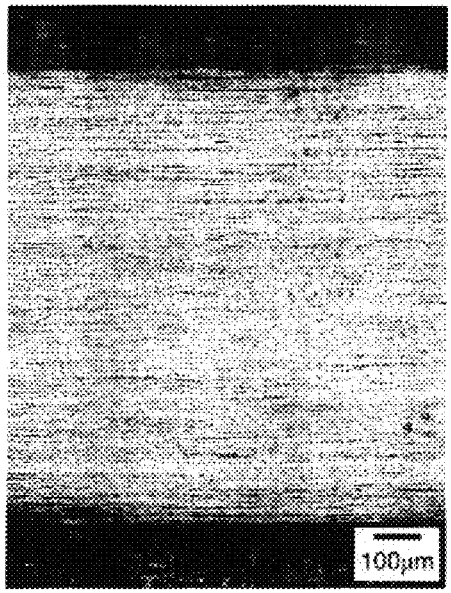

(2) Second internal nitriding step: The worked alloy material produced by the first nitriding step is heated at equal to or more than the lower limit temperature of recrystallization of the worked material in a nitriding atmosphere, thus leading to the grain growth and the stabilization of the ultrafine nitride particles. The grain growth and the stabilization of the precipitated particles induced by this second nitriding step further increases the recrystallization temperature. The conditions of heating temperature of the second nitriding step are determined such that a double layer formation is produced, the double layer formation including a structure with relatively-isometric and coarse crystal grain, which is produced by recrystallization, formed inside of the worked material and including a worked structure or a recovered structure having fine and elongated crystal grains maintained at the surface region of the worked material. FIG. 3(*a*) shows these crystal grain structures of this worked material. In nitriding, recrystallization occurs inside of a worked material but a worked structure X2 still remains. When a worked material is relatively thin (3 mm or less), a worked structure can be completely maintained through the entire worked material.

In the first nitriding step, fine nitride particles (for example, TiN or (Ti, Zr)N) are precipitated and dispersed at the surface region of an alloy. The precipitated particles pin crystal grains in the surface region of the alloy to block the movement of the crystal grains. As a result, recrystallization is suppressed; hence, a worked structure or a recovered structure is maintained. On the other hand, nitride particles are not formed inside of a worked material during the first nitriding step. For example, in the case of a TZM alloy having a recrystallization temperature of 1300° C. or more, recrystallization completely occurs by the second nitriding step at 1600° C. exceeding the crystallization temperature of the TZM alloy to form a recrystallized structure. As a result, in this case, a material subjected to the second nitriding step exhibits a double layer formation.

(3) Third internal nitriding step: The worked alloy material produced by the previous steps is heated in a nitriding atmosphere at equal to or more than the lower limit temperature of recrystallization of the worked material, thus leading to the grain growth and the stabilization of the nitride particles.

An object of the third step and subsequent nitriding steps is to further grow and stabilize the nitride particles while retaining a work structure X3. Bar-shaped nitride particles having a thickness of about 10 nm and having a length of about 50 nm are uniformly dispersed in the molybdenum matrix.

(4) Fourth internal nitriding step: The temperature conditions of the fourth nitriding step are determined such that a worked crystal-grain structure or a recovered crystal-grain structure is formed through an entire worked material. Nitriding may be finished up to the third internal nitriding step. However, in this case, the resulting worked material can be used only at lower temperatures than the temperature at which a worked material subjected to fourth nitriding step can be used. When the difference between the temperature of the second nitriding step and the temperature of the third nitriding step is increased (for example, 1200° C.→1400° C.→1800° C.), recrystallization occurs during nitriding. Hence, increasing the temperature difference is inappropriate. When the difference is reduced (for example, 1200° C.→1400° C.→1600° C.), recrystallization does not occur during nitriding. Hence, the worked material can be used at 1600° C. or less. When the fourth nitriding step is performed (for example, 1200° C.→1400° C.→1600° C.→1800° C.), recrystallization does not occur during nitriding. Hence, the worked material can be used at 1800° C. or less.

In this way, a worked molybdenum-alloy material of the present invention has a recrystallization temperature of 1400° C. or more, which exceeds the recrystallization temperature of a known TZM alloy.

For example, in a TZM alloy, it is important that the first nitriding step and the second nitriding step be performed at a lower temperature than the recrystallization temperature (about 1300° C.) of the TZM alloy. That is, a specimen is completely nitrided up to the inside of the specimen by the first nitriding step and the second nitriding step. The specimen differs from the above-described material subjected to the second nitriding step in that fine nitride particles are precipitated and dispersed. For example, the first nitriding step was performed at 1150° C. for 64 hours, the second nitriding step was performed at 1200° C. for 25 hours, the third nitriding step was performed at 1300° C. for 25 hours, and the fourth nitriding step was performed at 1600° C. for 25 hours, to produce a material subjected to the fourth nitriding step. FIG. 3(*b*) shows the crystal grain structure of the cross section of the material subjected to fourth nitriding.

EXAMPLES

Example 1

A material subjected to the second nitriding step was manufactured as follows: A commercially available TZM alloy (Mo—Ti(0.5%)—Zr(0.08%)—C(0.03%)) in which TiC particles are precipitated and dispersed was subjected to heat treatment at 1150° C. for 4 hours, followed by 1600° C. for 25 hours in a nitrogen gas flow under a pressure of 1 atm. To investigate the stability of the crystal grain structure in the worked material, the worked material was subjected to heat treatment at 1500° C. to 1800° C. for 1 hour in a high vacuum ($1.3\times10^{-4}$ Pa).

Example 2

A material subjected to fourth nitriding step was manufactured as follows: The same TZM alloy as in EXAMPLE 1 was subjected to the internal nitriding treatment, which included a stepwise increase of the heating temperature, at 1150° C. for 64 hours (first nitriding step), at 1200° C. for 25 hours (second nitriding step), at 1300° C. for 25 hours (third nitriding step), and at 1600° C. for 25 hours (fourth nitriding step), in that order, in a nitrogen gas flow under a pressure of 1 atm.

Comparative Example 1

The same TZM alloy as in EXAMPLE 1 was recrystallized at 1600° C. for 1 hour in a vacuum to largely grow crystal grains.

The properties of the treated specimens of EXAMPLES 1 AND 2 are described as follows.

(a) Stability of Crystal Grain at Ultra High Temperature (1600° C. to 1800° C.) (Recrystallization Temperature)

Specimens of EXAMPLE 2 (a material subjected to the fourth nitriding step) was subjected to heat treatment at 1600° C., 1700° C., and 1800° C. in a high vacuum ($1.3\times10^{-4}$ Pa). The stability of the crystal grain structure was evaluated by observing the crystal grain structures of the cross section of the worked material. As a result, it was found that the material subjected to the fourth nitriding step was not recrystallized up to 1800° C. and that the worked structure or the recovered structure was stably maintained. That is, the recrystallization temperature of the material subjected to the fourth nitriding step was significantly increased to 1800° C. or more (the recrystallization temperature of the untreated TZM alloy was 1300° C.). Consequently, the fourth nitriding step has the effect of significantly increasing the recrystallization temperature at least 500° C. higher than the recrystallization temperature of the untreated TZM alloy.

(b) Strength Property at Room Temperature

Figure 4:
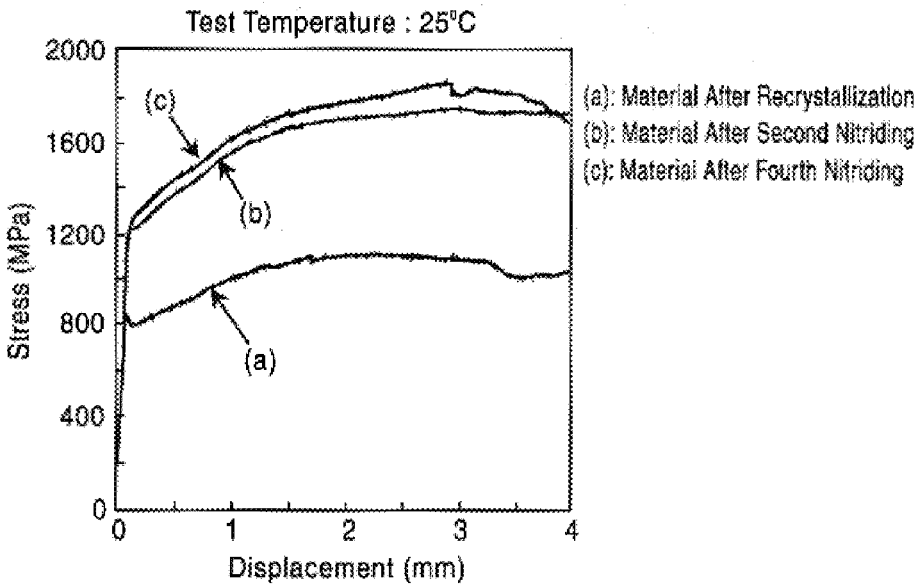
FIG. 4 is a graph showing the relationship between the stress and the displacement when each treated specimen of Example 1 (represented as (b) in the graph), Example 2 (represented as (c) in the graph), and Comparative Example 1 (represented as (a) in the graph) is subjected to three-point bending at 25° C.

FIG. 4 is a graph showing the relationship between the stress and the displacement of each specimen of Example 1 (material subjected to second nitriding), Example 2 (material subjected to fourth nitriding), and Comparative Example 1 (recrystallized material), at room temperature (25° C.). As shown in FIG. 4, both the materials subjected to the second and fourth nitriding steps exhibit satisfactory plastic deformation, in other words, both the materials exhibit high toughness at room temperature. Furthermore, in both the materials, yield strength is increased about 1.5 times that of the recrystallized material. This increase in yield strength results from a combination of strengthening by dispersion of the fine nitride particles and strengthening by a reduction in size of crystal grains in a worked structure or a recovered structure.

(c) Strength Property at Ultra High Temperature

A specimen of EXAMPLE 2 (material subjected to the fourth nitriding step) and a specimen of COMPARATIVE EXAMPLE 1 (recrystallized material) were tested by three-point bending at 1500° C. Each specimen tested by static three-point bending had a width of 2.5 mm, a length of 25 mm, and a thickness of 1 mm. Each specimen tested by impact three-point bending had a width of 1 mm, a length of 20 mm, and a thickness of 1 mm.

As a result, it was found that the yield stress of the material subjected to the fourth nitriding step was significantly increased (about two times) compared with the yield stress of the recrystallized material. In addition, it was also found that the material subjected to the fourth nitriding step had high toughness at a high temperature of 1500° C.

INDUSTRIAL APPLICABILITY

A worked molybdenum-alloy material having high strength and high toughness of the present invention is useful for, for example, supporting plates for semiconductors, ceramics, and metals; heaters for high-temperature furnaces; components for high-temperature furnaces; structural materials for chemical equipment and apparatuses used in corrosive atmospheres (including high-temperature incinerators); and materials for reactors with supercritical solutions or subcritical solutions.

The invention claimed is:

1. A worked molybdenum-alloy material having high strength and high toughness, comprising:

molybdenum matrix containing a nitride forming element dissolved therein forming a solid solution;

at least one of carbide particles, oxide particles, and boride particles precipitated and dispersed in said molybdenum matrix; and fine nitride particles dispersed in said molybdenum matrix, wherein said nitride particles are dispersed by internally nitriding a worked molybdenum-alloy material in which a nitride-forming-metal element is dissolved forming a solid solution in a molybdenum matrix and at least one of carbide particles, oxide particles, and boride particles is precipitated and dispersed, and wherein a worked crystal-grain structure or a recovered crystal-grain structure is maintained in both surface region and inner region of the worked molybdenum-alloy material, and the worked molybdenum-alloy material has a recrystallization temperature of 1800° C. or higher.

2. A method for manufacturing a molybdenum-alloy material having high strength and high toughness, comprising the steps of:

preparing a worked molybdenum-alloy material, comprising a molybdenum matrix, at least one of carbide particles, oxide particles, and boride particles precipitated and dispersed in said molybdenum matrix, and at least one of titanium, zirconium, hafnium, vanadium, niobium, and tantalum dissolved in said molybdenum matrix forming a solid solution; and subjecting said worked molybdenum-alloy material to a multi-step internal nitriding treatment including a stepwise increase of treatment temperature, the treatment temperature of each step being a temperature which does not cause recrystallization of said worked molybdenum-alloy material, wherein a worked crystal-grain structure or a recovered crystal-grain structure is maintained in both surface region and inner region of the worked molybdenum-alloy material, and the worked molybdenum-alloy material has a recrystallization temperature of 1800° C. or higher.

* * * * *